US009537270B2

(12) United States Patent
Saari et al.

(10) Patent No.: US 9,537,270 B2
(45) Date of Patent: Jan. 3, 2017

(54) METHOD AND APPARATUS FOR CONNECTIVITY PLUG SWITCH

(71) Applicant: Nokia Corporation, Espoo (FI)

(72) Inventors: Jarmo Ilkka Saari, Turku (FI); Timo Juhani Toivanen, Mantsala (FI)

(73) Assignee: Nokia Technologies Oy, Espoo (FI)

( * ) Notice: Subject to any disclaimer, the term of this patent is extended or adjusted under 35 U.S.C. 154(b) by 80 days.

(21) Appl. No.: 14/249,678

(22) Filed: Apr. 10, 2014

(65) Prior Publication Data

US 2015/0295370 A1 Oct. 15, 2015

(51) Int. Cl.

| | |
|---|---|
| ***H01R 24/04*** | (2006.01) |
| ***H01R 24/58*** | (2011.01) |
| ***H01R 13/703*** | (2006.01) |
| ***H01R 29/00*** | (2006.01) |
| *H01R 103/00* | (2006.01) |

(52) U.S. Cl.

CPC ..... *H01R 24/58* (2013.01); *H01R 13/703* (2013.01); *H01R 29/00* (2013.01); *H01R 2103/00* (2013.01)

(58) Field of Classification Search

CPC . H01R 24/58; H01R 2103/00; H01R 2107/00; H01R 2105/00

USPC ..... 439/668, 669

See application file for complete search history.

(56) References Cited

U.S. PATENT DOCUMENTS

| | | | | |
|---|---|---|---|---|
| 2,825,882 | A * | 3/1958 | Mitchell | H01R 24/58 439/314 |
| 4,275,947 | A * | 6/1981 | Takagi | H01R 24/58 200/51.09 |
| 4,325,599 | A * | 4/1982 | Feldman | H01R 24/58 439/468 |
| 7,922,543 | B1 * | 4/2011 | Chen | H01R 13/703 439/668 |
| 8,162,697 | B1 * | 4/2012 | Menolotto | H01R 13/7031 439/669 |
| 8,469,749 | B2 * | 6/2013 | Ladouceur | H01R 13/639 439/668 |
| 2008/0175402 | A1 | 7/2008 | Abe et al. | 381/71.6 |
| 2011/0237131 | A1 | 9/2011 | Fields et al. | 439/620.21 |

FOREIGN PATENT DOCUMENTS

| | | |
|---|---|---|
| KR | 100755860 B1 | 9/2007 |
| TW | M383236 Y | 6/2011 |

* cited by examiner

*Primary Examiner* — Hien Vu
(74) *Attorney, Agent, or Firm* — Harrington & Smith

(57) ABSTRACT

In accordance with an example embodiment of the present invention, a method is disclosed. A connector plug housing member is provided. A movable member is mounted inside the connector plug housing member. A contact member is provided inside the movable member. The movable member is configured to move between a first position and a second position. The movable member is configured to be connected to ground when the movable member is moved from the first position to the second position.

16 Claims, 10 Drawing Sheets

METHOD AND APPARATUS FOR CONNECTIVITY PLUG SWITCH

TECHNICAL FIELD

The invention relates to a connector plug and, more particularly, to a connector plug suitable for connecting to a headset jack or socket of an electronic device.

BACKGROUND

Electronic devices include many different features, and as electronic devices continue to become more sophisticated, these devices provide an increasing amount of functionality. Many of these devices include connector interfaces allowing for peripheral components to be connected to the device and/or communication to other electronic devices.

As such, features for electronic devices are increasing in number. Thus, the electronic device facilitates a better user experience. Therefore versatile user interface components are needed in order to take full advantage of capabilities of electronic devices.

SUMMARY

Various aspects of examples of the invention are set out in the claims.

According to a first aspect of the invention, a method is disclosed. A connector plug housing member is provided. A movable member is mounted inside the connector plug housing member. A contact member is provided inside the movable member. The movable member is configured to move between a first position and a second position. The movable member is configured to be connected to ground when the movable member is moved from the first position to the second position.

According to another aspect of the invention, an apparatus is disclosed. The apparatus includes a connector plug housing member, a movable member, and a contact member. The movable member is mounted inside the connector plug housing member. The contact member is inside the movable member. The movable member is configured to move between a first position and a second position. The movable member is configured to be connected to ground when the movable member is moved from the first position to the second position.

According to another aspect of the invention, a method is disclosed. A contact member is inserted into a mating socket connector. A movable member is moved between a first position and a second position when the movable member contacts the mating socket connector. The movable member is connected to ground in response to the moving of the movable member from the first position to the second position.

BRIEF DESCRIPTION OF THE DRAWINGS

For a more complete understanding of example embodiments of the present invention, reference is now made to the following descriptions taken in connection with the accompanying drawings in which.

DETAILED DESCRIPTION OF THE DRAWINGS

An example embodiment of the present invention and its potential advantages are understood by referring to FIGS. 1 through 13 of the drawings.

Figure 1:
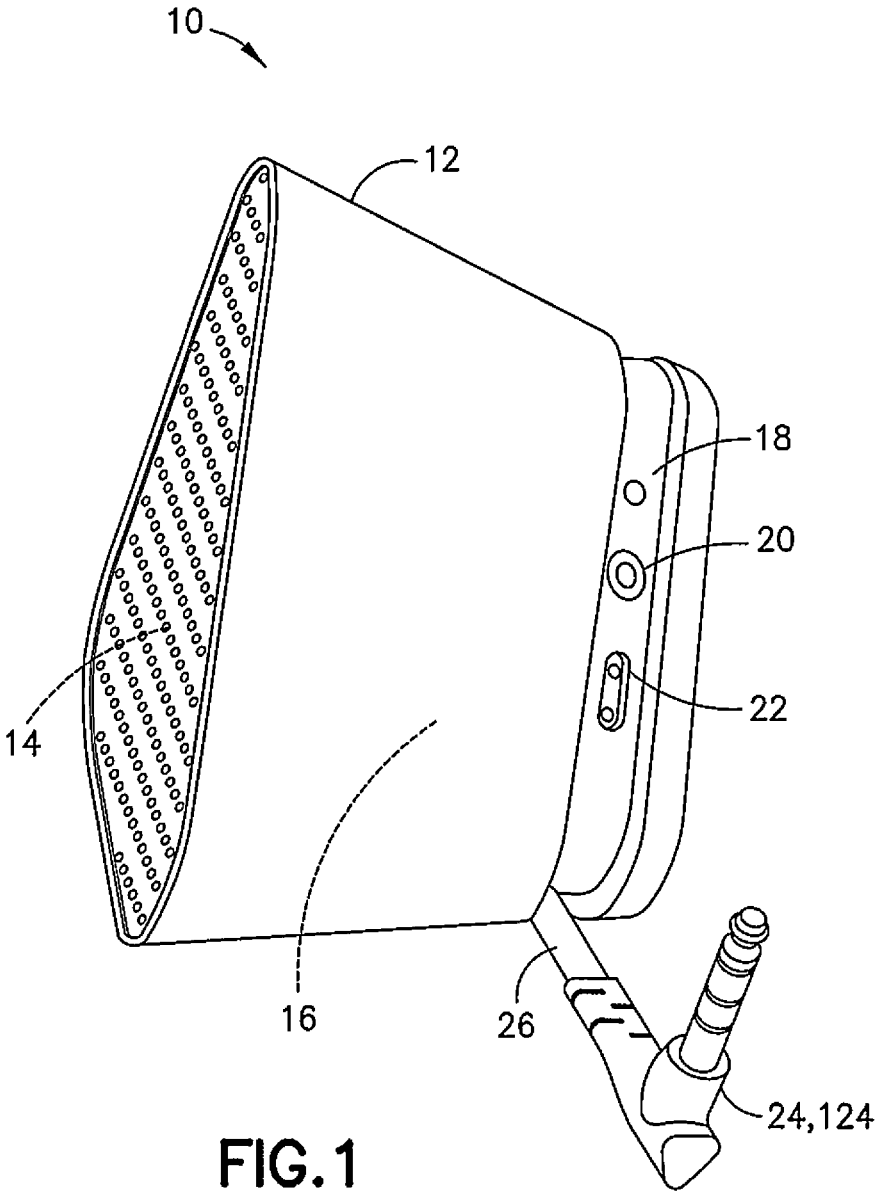
FIG. 1 is a perspective view of a wired device incorporating features of the invention.

Referring to FIG. 1, there is shown a perspective view of a wired device 10 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

According to one example of the invention, the wired device 10 comprises a portable wired speaker device having a single speaker and/or speaker housing. However, in alternate embodiments, features of the various embodiments of the invention could be used in any suitable type of wired speaker device such as a speaker arrangement having multiple speakers and/or speaker housings. Additionally, according to some embodiments of the invention, the wired device 10 may be a single earpiece headset device such as mobile phone hands free headset, a double ear piece headset, an "over the head" headset, or an "over the ear" headset, for example. In other alternate embodiments, features of the various embodiments of the invention could be used in any suitable type of peripheral device (such as headphones, earphones, or speakers, for example) which utilizes a connector or plug which can provide an end-termination for cabling and can be used to connect the peripheral device to an electronic device. The connector/plug is generally configured to provide releasable connection with a jack or socket. In this way, the electronic device is able to output and receive information.

According to various exemplary embodiments of the invention, the wired device 10 is configured to be connected to any suitable type of electronic device such as a mobile phone, a tablet, a laptop computer, a desktop computer, a wearable device, a gaming device, a music player, or a PDA, for example. In addition, as is known in the art, the electronic device can include multiple features or applications such as a camera, a music player, a game player, or an Internet browser, for example. The electronic device generally comprises a housing, a transmitter, a receiver, an antenna (connected to the transmitter and the receiver), electronic circuitry, such as a controller (which could include a processor, for example) and a memory for example, within the housing, a user input region and a display. However, any suitable type of features as known in the art, can be provided.

The wired device 10 comprises a housing 12, a speaker 14, a battery 16, an indicator light 18, a round socket (or jack) 20, a USB jack 22, and a connector plug section 24. According to some embodiments of the invention, the housing 12 is formed from a plastic material, however in alternate embodiments the housing may be formed from any suitable type material. The speaker 14 is mounted inside the housing 12. The battery 16 is mounted inside the housing 12. The indicator light 18, which may be an LED light for power indication, for example, is at an exterior portion of the housing 12. The round socket (or jack) 20, which may be a 3.5 mm audio out socket to queue speakers for example, is at the exterior portion of the housing 12. The USB jack 22, which may be Micro USB jack for battery charging for example, is at the exterior portion of the housing 12. The connector plug section 24, which may be a 'audio in' connector for connection to the audio source, for example, is connected to the housing 12 (and internal circuitry inside the housing) by a cable 26. Additionally, in alternate embodiments, the wired device 10 may comprise any suitable type of features as known in the art.

Figure 2:
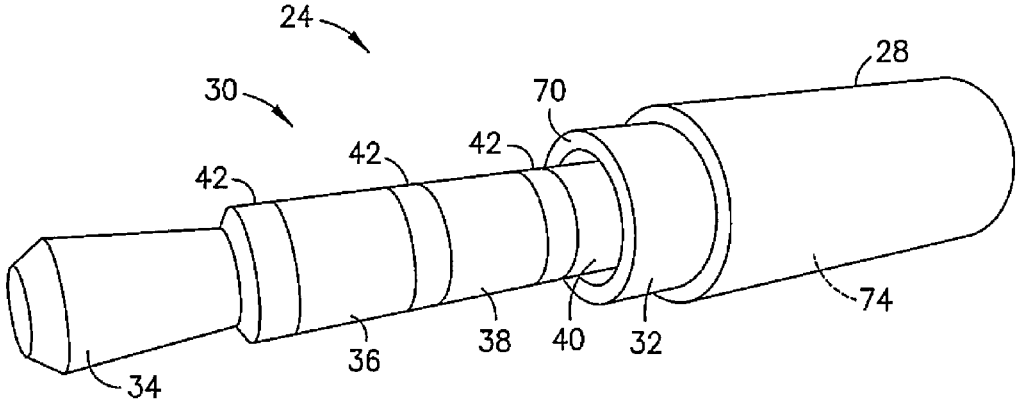
FIG. 2 is an enlarged perspective view of a connector plug section (with a movable member in a first position) of the wired device shown in FIG. 1.

Referring now also to FIG. 2, the connector plug section 24 comprises a connector plug housing member 28, a connector plug contact member 30, and a barrel sleeve 32.

The connector plug contact member (or contact member) 30 may include a circular connector configuration such as a 2.5 mm or 3.5 mm connector commonly used for audio/video connections, for example. The connector plug contact member 30 generally comprises a tip section 34, a first ring section 36, a second ring section 38, and a barrel section (or first terminal section) 40. The connector plug contact member 30 further comprises insulating sections 42 between the tip section 34, the first ring section 36, the second ring section 38, and the barrel section 40. The tip section 34, the first ring section 36, the second ring section 38, and the barrel section 40 provide electrical contact areas, spaced along a length of the connector. The contact areas are generally separated by the insulating material 42 to keep the areas separate from each other. It should be noted that, although the connector plug contact section has been described in connection with a four pin configuration having two ring sections, one skilled in the art will appreciate that embodiments of the invention are not necessarily so limited and that alternate embodiments may comprise more or less pins and ring sections.

The connector plug contact member 30 is configured to be insertable into a connector socket of an electronic device. However, the connector plug contact member may be configured to be insertable into any suitable type of connector socket. When the connector plug contact member of the connector plug is inserted into a connector socket or jack, the contact areas of the connector plug contact member form an electrical connection with mating contact areas of the connector socket. The contact areas of the connector plug contact member and the mating contact areas of the connector socket generally correspond to left and right speaker signals, ground signal, and so forth.

The barrel sleeve (or movable member) 32 is movably disposed between the barrel section 40 and the connector plug housing member 28 and is configured to provide an audio plug insertion detection feature. According to various exemplary embodiments of the invention, the connector plug housing member 28, the barrel sleeve 32, and the barrel section 40, comprise a general cylindrical shape, wherein the barrel sleeve 32 is configured to slide over the barrel section 40 with an insulator 44 (also having a general cylindrical shape) therebetween. According to various exemplary embodiments, the insulator 44 is fixed to the barrel section 40 and the barrel sleeve 32 is configured to slide over the insulator 44, wherein an inside diameter of the barrel sleeve 32 slides over an outside diameter of the insulator 44. However, in alternate embodiments, the insulator 44 may be fixed to the barrel sleeve 32 and the barrel section 40 may be configured to slide at the inside diameter of the insulator 44.

Figure 3:
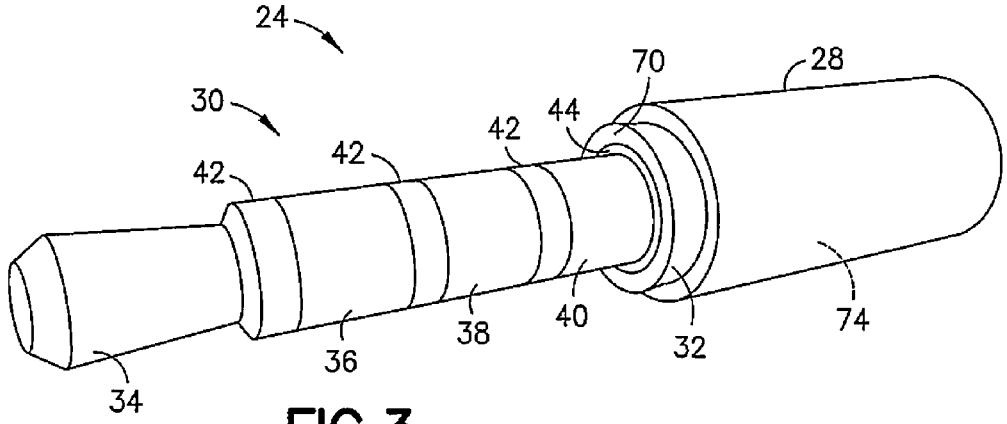
FIG. 3 is an enlarged perspective view of the connector plug section (with the movable member in a second position) of the wired device shown in FIG. 1.
Figure 4:
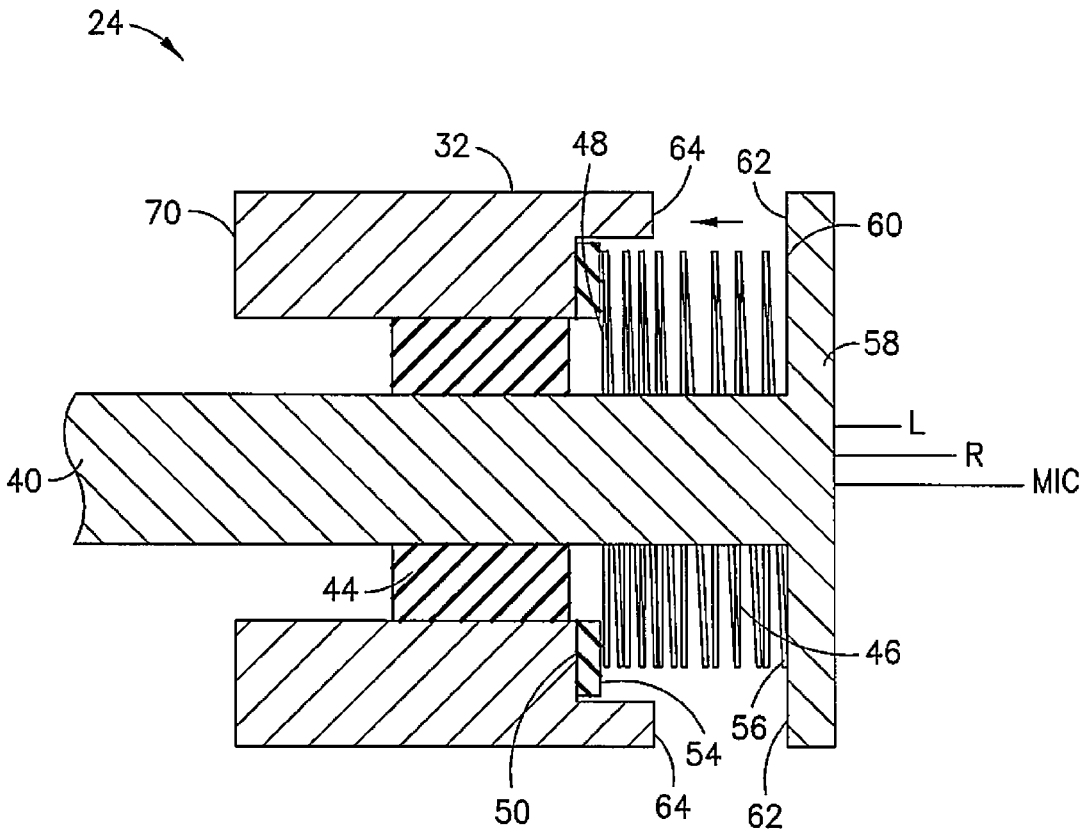
FIG. 4 is a section view of a portion of the connector plug section shown in FIG. 2.
Figure 5:
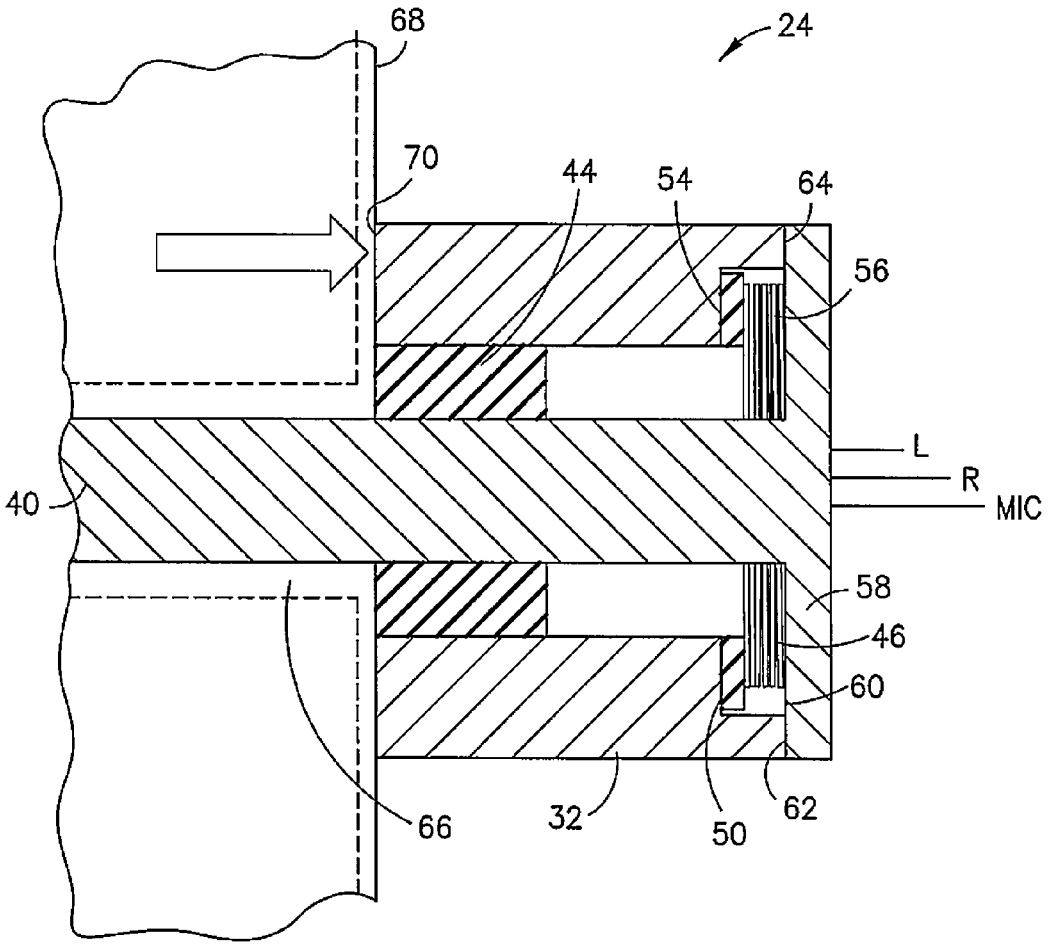
FIG. 5 is a section view of a portion of the connector plug section shown in FIG. 3.

Referring now also to FIGS. 3-5, the barrel sleeve 32 is configured to slide (or move) between a first position (as shown in FIGS. 2, 4) and a second position (as shown in FIGS. 3, 5). It should be noted that the connector plug housing section 28 is not shown in FIGS. 4, 5 for the purposes of clarity.

The connector plug section 24 is configured such that the barrel sleeve 32 is biased in the first position due to a force of a compression spring 46 disposed between the barrel sleeve 32 and the barrel section 40. One end 48 of the spring 44 is configured to apply a force to a recessed surface 50 of the back end 52 of the barrel sleeve 32. As shown in FIGS. 4 and 5, the connector plug section 24 comprises an insulator 54 between the recessed surface 50 and the end of the spring 48. The insulator 54 provides for electrically isolating the spring 54. The other end 56 of the spring 46 contacts a base portion 58 of the barrel section 40. The base portion 58 comprises a spring contact surface 60 and a sleeve contact surface 62. The spring contact surface 60 is at a center area of the base portion 58 opposite the end of the spring 56. The sleeve contact surface 62 is proximate an outer perimeter of the base portion 58 opposite a contact area 64 of the barrel sleeve 32.

According to various exemplary embodiments of the invention, the configuration illustrated in FIG. 2, may correspond to an OMTP (Open Mobile Telephony Platform) standard wherein, the barrel section 40 provides a ground signal, the second ring section 38 provides a microphone/control signal, the first ring section 36 provides a right audio channel signal, and the tip section 34 provides a left audio channel signal. The configuration of the contact areas provides an electrical configuration pattern (or circuit pattern) for the connector plug.

However, it should be noted that in other exemplary embodiments of the invention, any other suitable industry accepted pinning order for four pin headset connectors may be provided. For example, according to various exemplary embodiments of the invention, the configuration illustrated in FIGS. 2, 3 may instead correspond to an AHJ (American Headset Jack) standard. Additionally, any other suitable pin configuration (or pinning order) may be provided.

According to the embodiment shown in FIGS. 2-5, the barrel section 40 (and the base portion 58) is connected to a ground pin, connections for the left audio channel, the right audio channel, and the microphone extend through and out of the ground barrel (or barrel section) 40. Additionally, a test pin (or first contact) is connected to the barrel sleeve 32.

The test pin and barrel sleeve (or jacket) surround the barrel section in a movable (slidably) configuration to allow for the device to trigger an event when the plug is inserted to another other device audio socket. For example, in some embodiments of the invention, the triggered event is to turn on the wired speaker device 10 when the connector plug section is connected to an electronic device (such as a mobile phone, for example). In other embodiments, the triggered event is to allow the device to know when the connector plug is inserted to another device audio socket. However, any other suitable event may be triggered when the plug is inserted to another device audio socket.

The barrel sleeve 32 is configured to move from the first position (FIGS. 2, 4) to the second position (FIGS. 3, 5) when the plug is inserted into a socket 66 of another device 68 (see FIG. 5). For example, when the connector plug contact member is inserted into the socket 66, a front end 70 of the barrel sleeve 32 contacts the mating socket and the insertion force exerted on connector plug section 24 then overcomes the spring bias force of the spring 46 and allows the barrel sleeve 32 to slidably move inside the connector plug housing member 28 (when the plug is inserted into the socket) and connects to the barrel sleeve 32 to the ground pin (as the ground and test pins are connected [by contact at areas 62, 64]) as shown in FIG. 5.

This for example could provide for a triggering event when the barrel sleeve 32 moves inside the connector plug housing member 28 (when plug is inserted to the socket) and causes the sleeve 32 and ground to be connected galvanically. This event causes the testing pin to be shorted to indicate for the system (such as the wired speaker device 10) to power "on" (or to take other action).

The barrel sleeve 32 is configured to move from the second position (FIGS. 3, 5) to the first position (FIGS. 2, 4) when the plug is removed from the socket 66. For example, when the connector plug contact member is removed from the socket 66, linear movement (or sliding) of the barrel sleeve 32 separates the connection at areas 62, 54 (due to the force of the spring 46).

As the barrel sleeve 32 moves along a length of the barrel section towards the tip section 34 (or towards the distal end of the plug), the disconnecting of the test pin and ground pin at areas 62, 64 provides an indication for the system (such as the wired speaker device 10) to power "off" (or to take other action).

Figure 6:
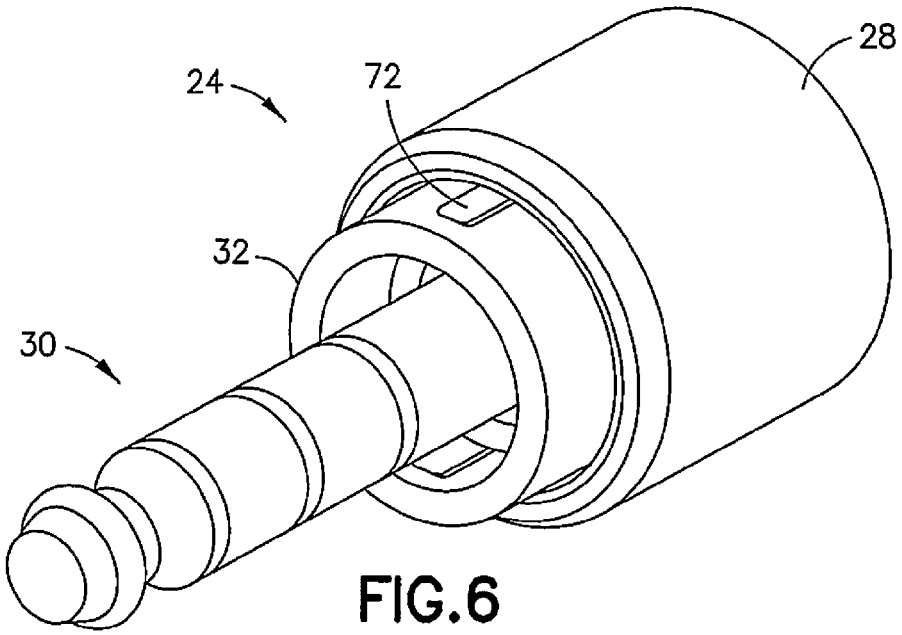
FIG. 6 is an enlarged perspective view of a connector plug section (with a movable member in a first position) of the wired device shown in FIG. 1.
Figure 7:
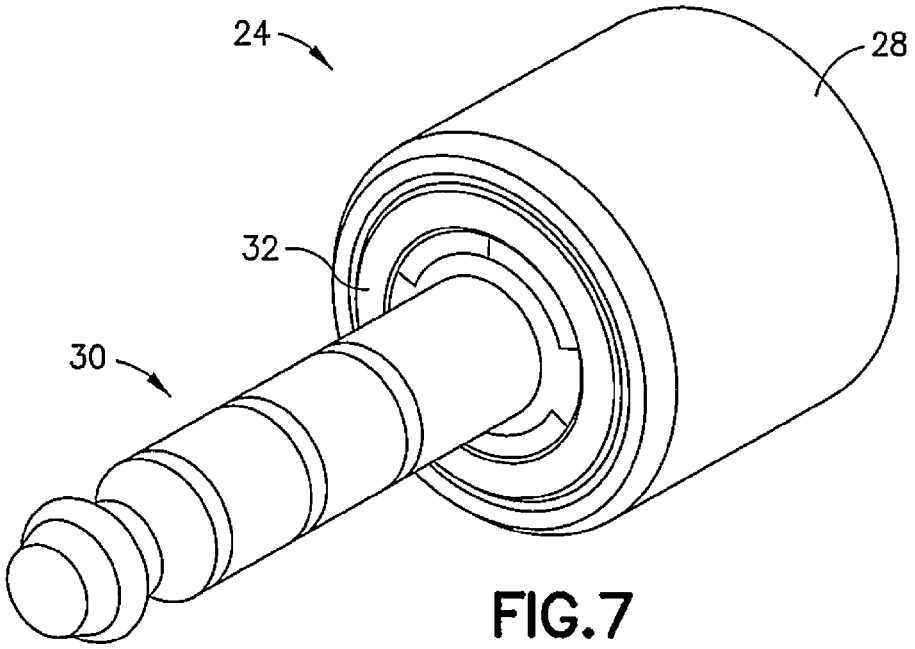
FIG. 7 is an enlarged perspective view of the connector plug section (with the movable member in a second position) of the wired device shown in FIG. 1.

Referring now also to FIG. 6 (which corresponds to the first position) and to FIG. 7 (which corresponds to the second position), various exemplary embodiments of the invention may further comprise an alignment feature 72. For example, the barrel sleeve 32 may comprise a slot which receives a protruding portion of the connector plug housing member or the barrel insulator so as to maintain linear movement and alignment of the barrel sleeve 32. Additionally, connection to terminal socket event is understood by barrel sleeve movement around the jacket core, which connects test pin (inside the jacket core) to jacket ground pin. This allows for audio devices using a standard jack to monitor impedance (open, short) seen in the test pin to know when the socket is connected.

Referring now also to FIGS. 8-11, another example embodiment of the invention is shown. The connector plug section 124 is similar to the connector plug section 24 and similar features are similarly numbered. It should be noted that the connector plug housing section is not shown in FIGS. 8-11 for the purposes of clarity. Also similar to above, FIGS. 8, 10 correspond to the first position, and FIGS. 9, 11 correspond to the second position.

Figure 8:
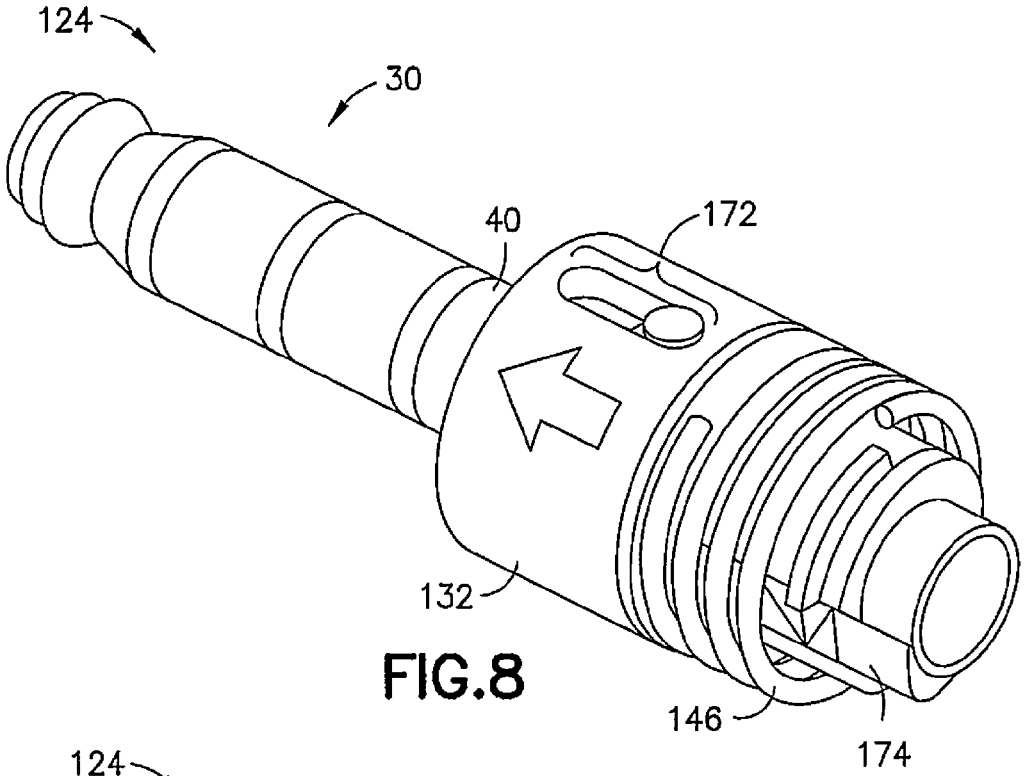
FIG. 8 is a perspective view of the connector plug section shown in FIG. 6.
Figure 9:
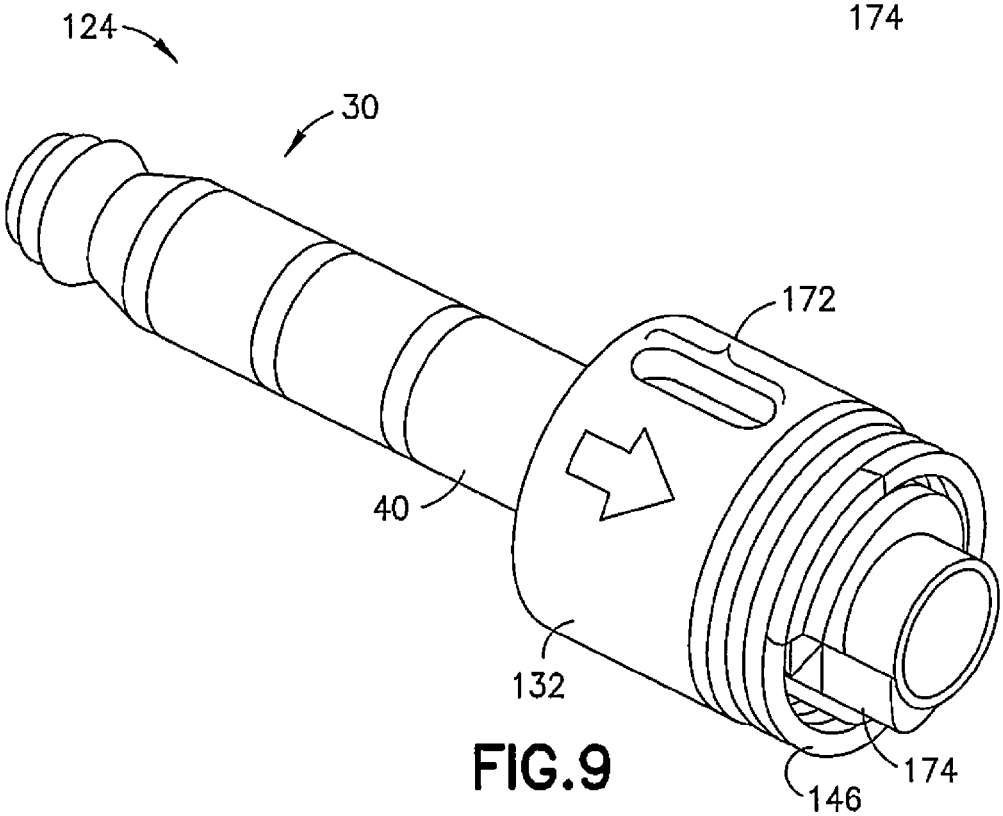
FIG. 9 is a perspective view of the connector plug section shown in FIG. 7.
Figure 10:
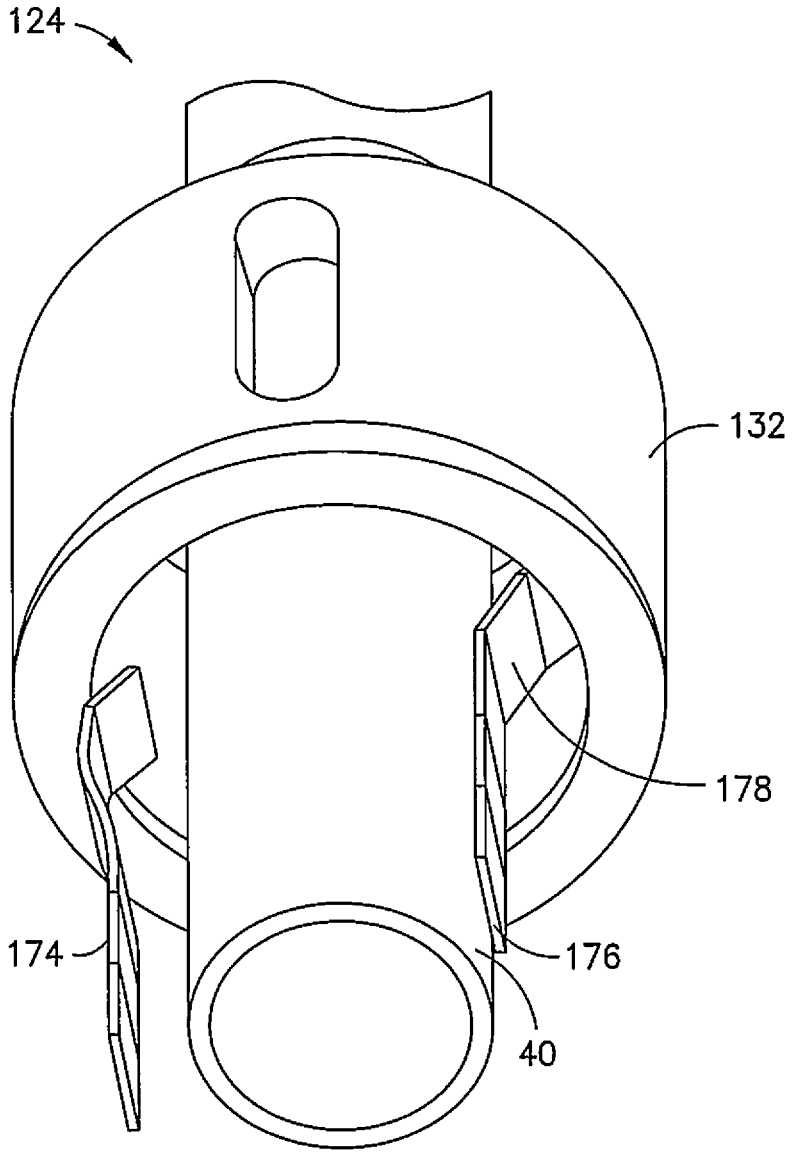
FIG. 10 is an enlarged perspective view of another embodiment of connector plug section (with a movable member in a first position) of the wired device shown in FIG. 1.
Figure 11:
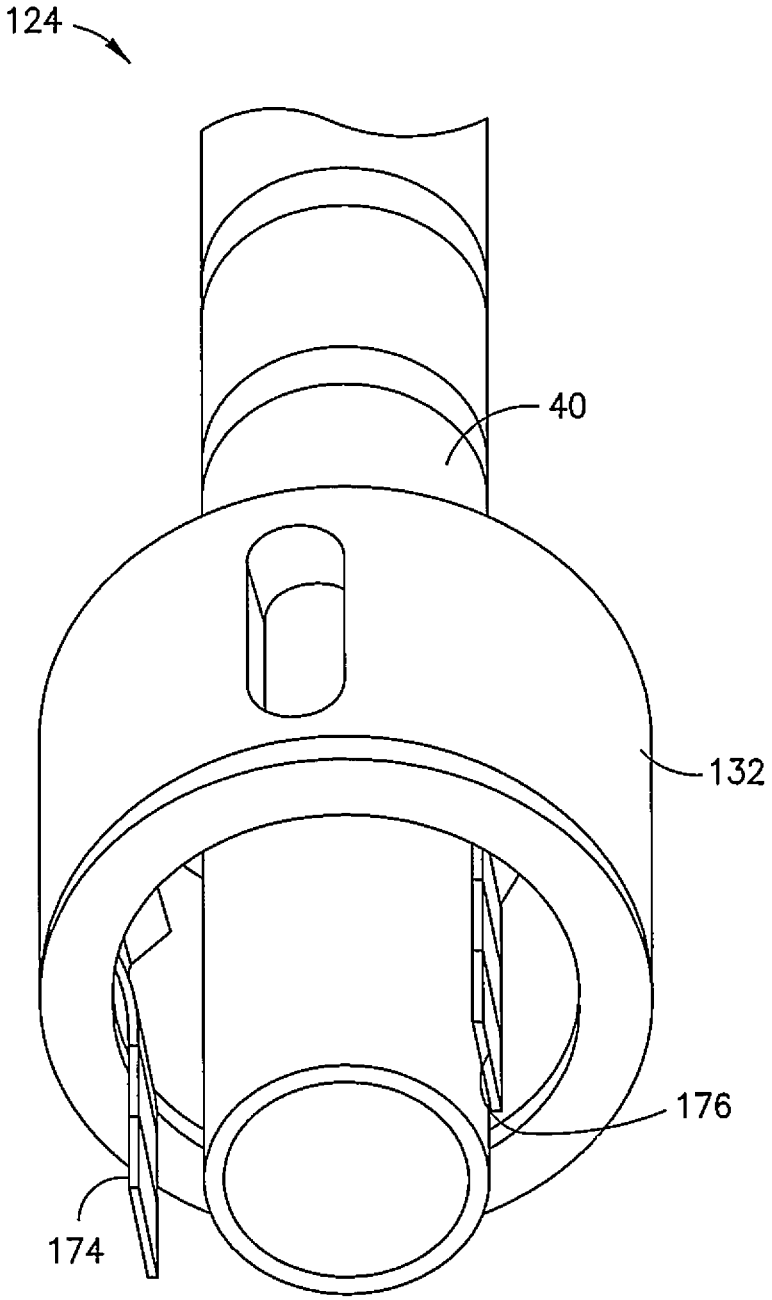
FIG. 11 is an enlarged perspective view of the connector plug section (with the movable member in a second position) shown in FIG. 10.

Similar to the embodiments above, the barrel sleeve 132 movement is linear (provided by the alignment feature 172). In this embodiment, the barrel sleeve 132 is always connected to the ground pin through the spring 146, and connects the test pin (or first contact) 174 to ground through another spring when barrel is moved in. As shown in FIG. 9, the barrel sleeve 132 is pushed in (such as in to the connector plug housing member) by the contact force against the other device socket (which overcomes the force of the spring 146). As shown in FIG. 8, the spring 146 pushes the barrel sleeve out, when the connector 124 removed from the socket. Additionally, as shown in FIG. 11, ground is connected to the barrel 40 internally, and the test pin 174 is shorted to ground through the barrel contact (in the second position). As shown in FIG. 10, the test pin 174 is 'OPEN', and the ground pin 176 is always connected to barrel through the spring 178. Additionally, it should be noted that similar to the embodiments above, connections for ground, the left audio channel, the right audio channel, and the microphone extend through and out of the ground barrel (or barrel section) 40.

Figure 12:
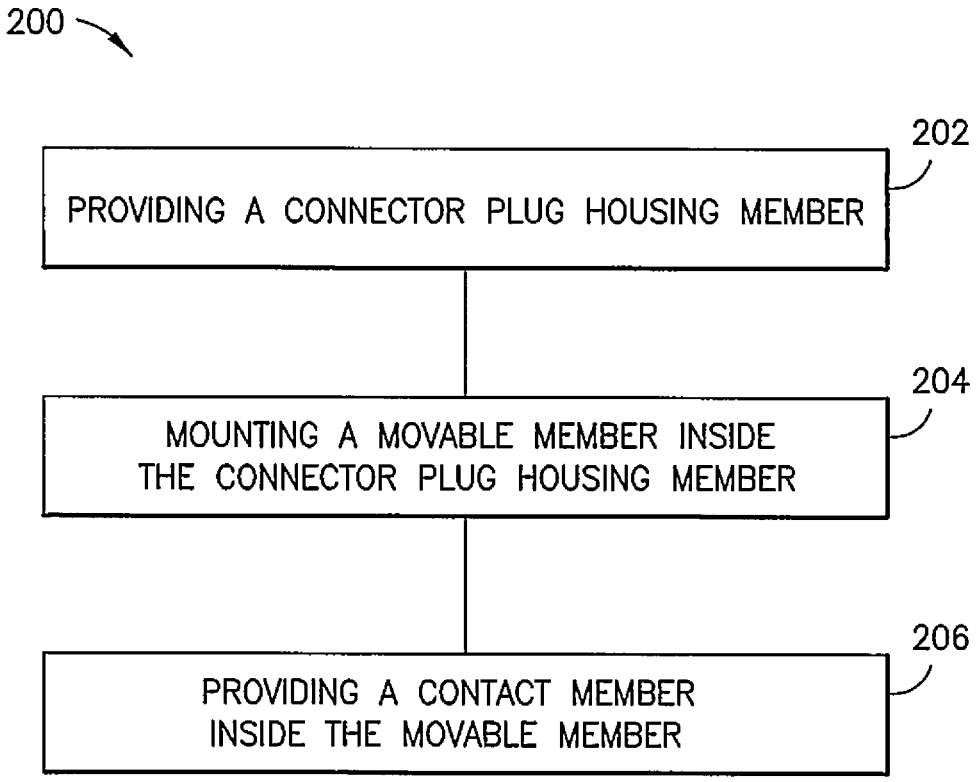
FIG. 12 is a block diagram of an exemplary method of the device shown in FIG. 1.

FIG. 12 illustrates a method 200. The method 200 includes providing a connector plug housing member (at block 202). Mounting a movable member (or barrel sleeve) inside the connector plug housing member (at block 204). Providing a contact member (or connector plug contact member) inside the movable member. Wherein the movable member is configured to move between a first position and a second position, and wherein the movable member is configured to be connected to ground when the movable member is moved from the first position to the second position (at block 206). It should be noted that the illustration of a particular order of the blocks does not necessarily imply that there is a required or preferred order for the blocks and the order and arrangement of the blocks may be varied. Furthermore it may be possible for some blocks to be omitted.

Figure 13:
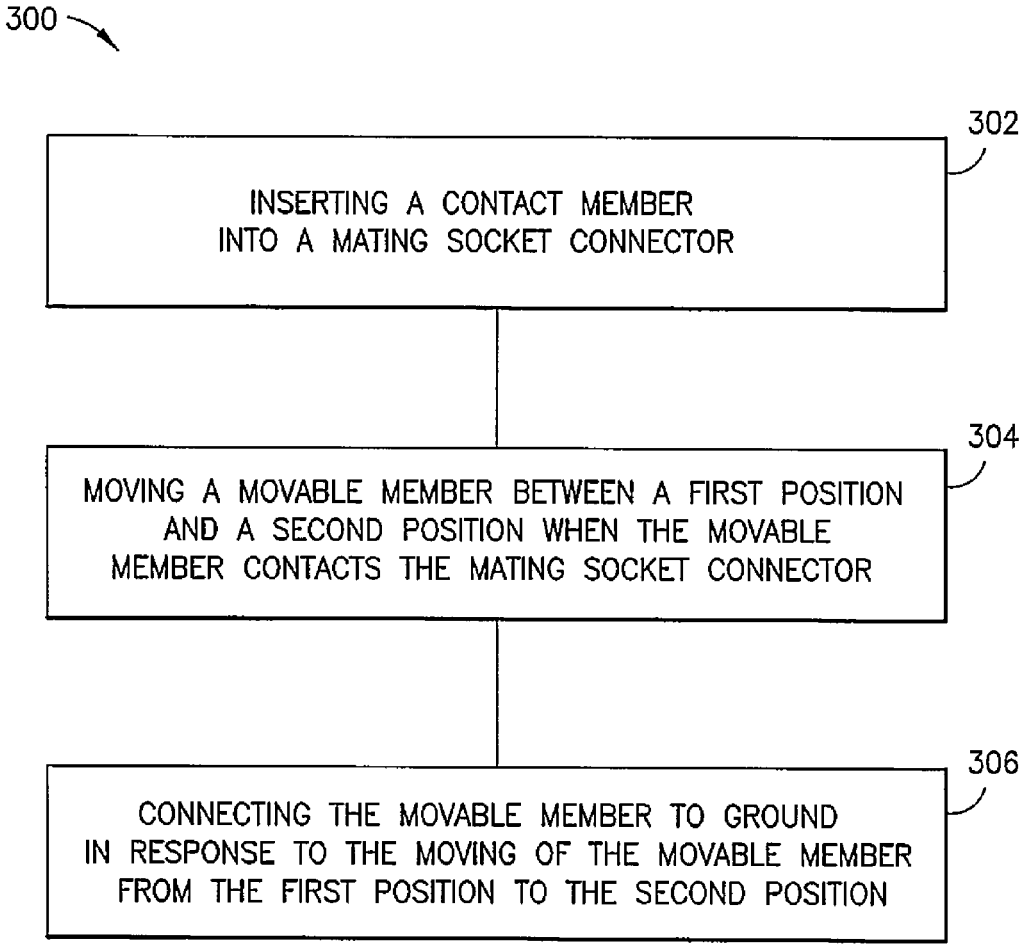
FIG. 13 is a block diagram of another exemplary method of the device shown in FIG. 1.

FIG. 13 illustrates a method 300. The method 300 includes inserting a contact member (or connector plug contact member) into a mating socket connector (at block 302). Moving a movable member (or barrel sleeve) between a first position and a second position when the movable member contacts the mating socket connector (at block 304). Connecting the movable member to ground in response to the moving of the movable member from the first position to the second position (at block 306). It should be noted that the illustration of a particular order of the blocks does not necessarily imply that there is a required or preferred order for the blocks and the order and arrangement of the blocks may be varied. Furthermore it may be possible for some blocks to be omitted.

Technical effects of any one or more of the exemplary embodiments provide improvements when compared to other configurations. For example, using methods such as mic bias voltage level detection is generally not possible because of different behavior of separate phone platforms. Also detecting the audio channels activity poses challenges due to varying voltage levels (used volume levels).

Without in any way limiting the scope, interpretation, or application of the claims appearing below, a technical effect of one or more of the example embodiments disclosed herein is triggering an event when the fixed cable plug (such as a 2.5 mm or 3.5 mm audio jack, for example) is connected to an electronic device (such as a mobile phone, for example). Another technical effect of one or more of the example embodiments disclosed herein is to provide for audio plug insertion detection. Another technical effect of one or more of the example embodiments disclosed herein is to provide for turning 'on' a wired device (such as a battery powered speaker, for example) when the fixed cable is connected to an electronic device. Another technical effect of one or more of the example embodiments disclosed herein is providing simple and inexpensive solutions not possible with the above conventional methods. Another technical effect of one or more of the example embodiments disclosed herein is allowing the plug to socket event to be recognized on the accessory side and using that recognition to 'wake up' the device. This allows for a battery disconnected kind of deep power saving state on accessory, which yields to longer operating time for portable accessory. Another technical effect of one or more of the example embodiments disclosed herein is that the "audio hum" caused by touching accessory audio plug pin can be avoided, since accessory can be in 'non-audio mode' (such as power off, for example) until plug is connected to socket. Another technical effect of one or more of the example embodiments disclosed herein is that the audio accessory (such as the wired device, for example) does not require a power button. Another technical effect of one or more of the example embodiments disclosed herein is that plugging the connector into the socket provides a type of ON/OFF switch for the device.

While various exemplary embodiments of the invention have been described in connection with a linear barrel sleeve movement, alternate embodiments may include configurations where the barrel sleeve movement is at least partly rotational. Additionally, is some other embodiments, the test pin to ground pin short could happen also in other means, other than the spring approach (such as, the barrel sleeve could short two metal pieces with its edge, for example). Further, in some embodiments, the test pin to ground pin short/open could be also defined change in test pin terminal impedance. Also further, in some embodiments, the barrel sleeve return to the open (or first) position could be provided with any other suitable type of spring or elastic material.

It should also be understood that while various exemplary embodiments of the invention have been described in connection with an audio plug, one skilled in the art will appreciate that the various exemplary embodiments are not necessarily so limited and that in alternate embodiments the connector plug may include any other suitable type of plug (other than an audio plug). For example, in some alternative embodiments, the connector plug could be a power plug, for example, wherein there is a corresponding barrel movement to ground structure involved to allow similar detection of the plug insertion into a socket as described for the embodiments above. Additionally, instead of audio transfer then power transfer would be enabled. Further, any other suitable type configurations could be provided.

It should be understood that while various exemplary embodiments of the invention have been described in connection with a spring, one skilled in the art will appreciate that the various exemplary embodiments are not necessarily so limited and that in alternate embodiments any suitable type of resilient member (or any other suitable member having spring like functionality) may be provided. For example, according to various exemplary embodiments, the spring may be replaced with a biased member which may work between two positions where the biased member may not look like a spring but can comprise spring like functionality, wherein the biased member is configured such that the movable member (or barrel sleeve) can be locked in the second position (when forced/connected/interfaced to the mating socket), and wherein the movable member can move back to the first position when not connected to the mating socket.

It should be further understood that components of the invention can be operationally coupled or connected and that any number or combination of intervening elements can exist (including no intervening elements). The connections can be direct or indirect and additionally there can merely be a functional relationship between components.

As used in this application, the term 'circuitry' refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in server, a cellular network device, or other network device.

Below are provided further descriptions of various non-limiting, exemplary embodiments. The below-described exemplary embodiments may be practiced in conjunction with one or more other aspects or exemplary embodiments. That is, the exemplary embodiments of the invention, such as those described immediately below, may be implemented, practiced or utilized in any combination (e.g., any combination that is suitable, practicable and/or feasible) and are not limited only to those combinations described herein and/or included in the appended claims.

In one exemplary embodiment, a method of triggering an event (such as, turning on the battery power to the speakers, for example) is provided, wherein when the fixed cable plug (such as a 2.5 or a 3.5 mm audio jack) is connected to the electronic device. A barrel sleeve is added around the plug which moves inside the plastic connector housing part. When the plug is inserted into the socket, the sleeve and ground are connected which indicates the system to trigger an event (such as, turning on the power or taking any other action, for example).

In another exemplary embodiment, a method, comprising: providing a connector plug housing member; mounting a movable member inside the connector plug housing member; and providing a contact member inside the movable member; wherein the movable member is configured to move between a first position and a second position, and wherein the movable member is configured to be connected to ground when the movable member is moved from the first position to the second position.

A method as above wherein the movable member is configured to move inside the connector plug housing member.

A method as above further comprising providing an insulator between the movable member and a first terminal section of the contact member.

A method as above further comprising connecting a first contact to the movable member.

A method as above further comprising providing a spring between the movable member and a first terminal section of the contact member.

A method as above further comprising providing an insulator between an end of the spring and the movable member.

A method as above wherein the spring is configured to bias the movable member to the first position.

A method as above wherein the movable member is closer to a tip section of the contact member in the first position than in the second position.

In another exemplary embodiment, an apparatus, comprising: a connector plug housing member; a movable member mounted inside the connector plug housing member; and a contact member inside the movable member; wherein the movable member is configured to move between a first position and a second position, and wherein the movable member is configured to be connected to ground when the movable member is moved from the first position to the second position.

An apparatus as above wherein the movable member is configured to move inside the connector plug housing member.

An apparatus as above further comprising an insulator between the movable member and a first terminal section of the contact member.

An apparatus as above wherein a first contact is connected to the movable member.

An apparatus as above further comprising a spring between the movable member and a first terminal section of the contact member.

An apparatus as above further comprising an insulator between an end of the spring and the movable member.

An apparatus as above wherein the spring biases the movable member to the first position.

An apparatus as above wherein the movable member is closer to a tip section of the contact member in the first position than in the second position.

In another exemplary embodiment, a method, comprising: inserting a contact member into a mating socket connector; moving a movable member between a first position and a second position when the movable member contacts the mating socket connector; and connecting the movable member to ground in response to the moving of the movable member from the first position to the second position.

A method as above wherein inserting of the contact member into a mating socket connector further comprises overcoming a spring force acting against the movable member.

A method as above wherein the movable member is connected to a first contact, and wherein the ground and the first contact are connected in response to the moving of the movable member from the first position to the second position.

A method as above further comprising removing the contact member from the mating socket connector, and moving the movable member from the second position to the first position when contact member is removed from the mating socket connector.

If desired, the different functions discussed herein may be performed in a different order and/or concurrently with each other. Furthermore, if desired, one or more of the above-described functions may be optional or may be combined.

Although various aspects of the invention are set out in the independent claims, other aspects of the invention comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present invention as defined in the appended claims.

What is claimed is:

1. A method for making an electrical connector, comprising:

providing a connector plug housing member;

mounting a movable member inside the connector plug housing member;

providing a contact member inside the movable member;

providing a spring between the movable member and a first terminal section of the contact member; and providing an insulator between an end of the spring and the movable member;

wherein the movable member is configured to move between a first position and a second position, and wherein the movable member is configured to be connected to ground when the movable member is moved from the first position to the second position.

2. The method of claim 1 wherein the movable member is configured to move inside the connector plug housing member.

3. The method of claim 1 further comprising providing an insulator between the movable member and a first terminal section of the contact member.

4. The method of claim 1 further comprising connecting a first contact to the movable member.

5. The method of claim 1 wherein the spring is configured to bias the movable member to the first position.

6. The method of claim 1 wherein the movable member is closer to a tip section of the contact member in the first position than in the second position.

7. An electrical connector apparatus, comprising:

a connector plug housing member;

a movable member mounted inside the connector plus housing member;

a contact member inside the movable member;

a spring between the movable member and a first terminal section of the contact member; and an insulator between an end of the spring and the movable member;

wherein the movable member is configured to move between a first position and a second position, and wherein the movable member is configured to be connected to ground when the movable member is moved from the first position to the second position.

8. The apparatus of claim 7 wherein the movable member is configured to move inside the connector plug housing member.

9. The apparatus of claim 7 further comprising an insulator between the movable member and a first terminal section of the contact member.

10. The apparatus of claim 7 wherein a first contact is connected to the movable member.

11. The apparatus of claim 7 wherein the spring biases the movable member to the first position.

12. The apparatus of claim 7 wherein the movable member is closer to a tip section of the contact member in the first position than in the second position.

13. A method for using an electrical connector, comprising:

inserting a contact member of a connector plug section into a mating socket connector;

moving a movable member between a first position and a second position when the movable member contacts the mating socket connector, wherein the connector plug section comprises a spring between the movable member and a first terminal section of the contact member, and wherein the connector plug section further comprises an insulator between an end of the spring and the movable member; and connecting the movable member to ground in response to the moving of the movable member from the first position to the second position.

14. The method of claim 13 wherein inserting of the contact member into a mating socket connector further comprises overcoming a spring force acting against the movable member.

15. The method of claim 13 wherein the movable member is connected to a first contact, and wherein the ground and the first contact are connected in response to the moving of the movable member from the first position to the second position.

16. The method of claim 13 further comprising removing the contact member from the mating socket connector, and moving the movable member from the second position to the first position when contact member is removed from the mating socket connector.

* * * * *